US008894421B2

(12) United States Patent
Nishikawa et al.

(10) Patent No.: US 8,894,421 B2
(45) Date of Patent: Nov. 25, 2014

(54) SHEET-LIKE CONNECTOR AND MANUFACTURING METHOD THEREOF

(75) Inventors: Masako Nishikawa, Yamato (JP); Toshihiro Niitsu, Yamato (JP)

(73) Assignee: Molex Incorporated, Lisle, IL (US)

( * ) Notice: Subject to any disclaimer, the term of this patent is extended or adjusted under 35 U.S.C. 154(b) by 438 days.

(21) Appl. No.: 13/172,326

(22) Filed: Jun. 29, 2011

(65) Prior Publication Data

US 2012/0003851 A1 Jan. 5, 2012

(30) Foreign Application Priority Data

Jun. 29, 2010 (JP) ..... 2010-147298

(51) Int. Cl.

| | |
|---|---|
| ***H01R 12/51*** | (2011.01) |
| ***H01R 12/71*** | (2011.01) |
| ***H01R 12/72*** | (2011.01) |
| ***H01R 13/24*** | (2006.01) |
| *H01R 13/03* | (2006.01) |

(52) U.S. Cl.

CPC ..... *H01R 12/714* (2013.01); *H01R 13/03* (2013.01); *H01R 12/72* (2013.01); *H01R 13/2407* (2013.01)

USPC ..... 439/78

(58) Field of Classification Search

USPC ..... 439/66, 91, 591

See application file for complete search history.

(56) References Cited

U.S. PATENT DOCUMENTS

| | | | | |
|---|---|---|---|---|
| 5,513,430 | A * | 5/1996 | Yanof et al. | 29/846 |
| 6,146,151 | A * | 11/2000 | Li | 439/66 |
| 6,328,573 | B1 * | 12/2001 | Sakata et al. | 439/66 |
| 7,005,751 | B2 * | 2/2006 | Khandros et al. | 257/780 |
| 7,245,135 | B2 * | 7/2007 | Ismail et al. | 324/755.05 |
| 7,549,871 | B2 * | 6/2009 | Pennypacker et al. | 439/66 |
| 7,758,351 | B2 * | 7/2010 | Brown et al. | 439/66 |
| 7,887,336 | B2 * | 2/2011 | Nikaido et al. | 439/66 |
| 2002/0187662 | A1 * | 12/2002 | Biegelsen et al. | 439/66 |
| 2006/0030169 | A1 * | 2/2006 | Noda et al. | 439/66 |
| 2006/0281342 | A1 * | 12/2006 | Self et al. | 439/66 |
| 2007/0020960 | A1 * | 1/2007 | Williams | 439/66 |
| 2007/0141863 | A1 * | 6/2007 | Williams | 439/66 |
| 2008/0020624 | A1 * | 1/2008 | Nikaido et al. | 439/342 |
| 2010/0075514 | A1 * | 3/2010 | Williams | 439/66 |
| 2011/0039427 | A1 * | 2/2011 | Mizoguchi | 439/77 |

FOREIGN PATENT DOCUMENTS

| | | |
|---|---|---|
| JP | 2007-076806 | 10/2008 |

* cited by examiner

*Primary Examiner* — Briggitte R Hammond
(74) *Attorney, Agent, or Firm* — Timothy M. Morella

(57) ABSTRACT

The sheet-like connector comprises a plurality of conductive members formed on one side of sheet. Each of the conductive members comprises elastically deformable spring member wherein edge thereof moves in the thickness direction of sheet, middle member which is formed on edge of spring member, and contacting protrusion which is formed on middle member and which protrudes in the thickness direction of sheet. Middle member and contacting protrusion are formed with materials which are mutually different and thus enable selective etching.

9 Claims, 12 Drawing Sheets

SHEET-LIKE CONNECTOR AND MANUFACTURING METHOD THEREOF

REFERENCE TO RELATED APPLICATIONS

The Present Disclosure claims priority to prior-filed Japanese Patent Application No. 2010-147298, entitled "Sheet-Like Connector And Manufacturing Method Thereof," filed on 29 Jun. 2010 with the Japanese Patent Office. The content of the aforementioned patent application is fully incorporated in its entirety herein.

BACKGROUND OF THE PRESENT DISCLOSURE

The Present Disclosure relates, generally, to a sheet-like connector for electrically connecting two mutually-facing circuit boards, and a manufacturing method thereof.

Japanese Patent Application No. 2007-076806 (Japanese Publication No. 2008-233022), for example, discloses a substrate (a probe substrate) on the surface of which conductive members in contact with an electrode pad of a semiconductor wafer are provided. In the '806 Application, each conductive member formed on the probe substrate possesses a spring-like member (hereafter, the spring member) which is parallel to the probe substrate; and on an end of the spring member, a protrusion protruding towards the electrode pad of the semiconductor wafer is provided. With the constitution as stated above, when the semiconductor wafer is pushed against the protrusion of the conductive member, the elasticity of the spring member is exhibited, and thus favorable contact stability can be obtained.

In the '806 Application, the conductive members are formed by conducting a plating treatment multiple times. Specifically speaking, the plating treatment is conducted along the resist pattern formed on the probe substrate, and the spring member is formed. Subsequently, another resist pattern is formed on the top of the above, and the plating treatment is conducted again along the corresponding resist pattern to form the protrusion.

SUMMARY OF THE PRESENT DISCLOSURE

Incidentally, connectors which are provided between two mutually-facing circuit boards and which electrically connect these circuit boards have been traditionally utilized. As a connector of this type, a sheet-like connector comprised of an insulating sheet and conductive members formed on both sides of the sheet through a plating treatment has been considered. In such a connector as stated above, it is effective for the conductive members to possess, similar to the '022 Application. For example, a conductive member comprised of a cantilever spring member formed by notching the sheet, and a protrusion protruding from the edge(s) of the spring member in the thickness direction of the sheet and in contact with the wiring pattern of one circuit board, is effective.

Some circuit boards may be prone to warping or variations in thickness. In consideration of the above, in order to obtain favorable contact stability with any circuit board, it is necessary to increase the height of the protrusion so that the motion range of the spring member will be expanded. However, when the conductive member possessing such a high protrusion is formed in the method disclosed in the '022 Application, it becomes difficult to achieve consistency in terms of the protrusion height between a plurality of protrusions, which is problematic. In other words, in the '022 Application, in forming the protrusions, resist patterns are formed first at locations corresponding to the locations of the protrusions; this causes metal to be accumulated through the plating treatment. However, the metal is not evenly accumulated at the locations of the respective protrusions, and thus the height of the resulting protrusions become inconsistent.

With regards to the point stated above, as an example, the following method might be utilized to make the protrusion height consistent. First of all, a first metal layer possessing a level of thickness equivalent to the thickness of the spring member is formed on the insulating sheet through a plating treatment, and then a second metal layer possessing the height of the protrusion is formed entirely on top of the above through the plating treatment. Subsequently, the portion excluding the protrusion is removed from the second metal layer through etching. According to this method, the inconsistency in the protrusion height can be reduced.

Nonetheless, in such a method as stated above, the spring member (or the first metal layer) is also eroded by the etching treatment which is conducted in order to form the protrusion. Because of the above, it is difficult to obtain an appropriately shaped spring member.

The Present Disclosure was developed in consideration of the problem stated above, and it serves to provide a sheet-like connector which enables an easier formation of the spring member, and a manufacturing method thereof.

In order to solve the problem stated above, the connector of the Present Disclosure comprises an insulating sheet and a plurality of conductive members formed on one side of the sheet. Each of the plurality of conductive members comprises an elastically deformable spring member wherein the edge thereof moves in the thickness direction of the sheet, a middle member which is formed on the edge of the spring member, and a contacting protrusion which is formed on the middle member and protrudes in the thickness direction of the sheet. The middle member and the contacting protrusion are formed with materials which are mutually different and thus enable selective etching.

According to the Present Disclosure, when the protrusion is formed from the metal layer through the etching treatment, the spring member or the metal layer for forming the spring member can be protected by the metal layer for forming the middle member. As a result of the above, the shape of the spring member can be appropriately made. Moreover, the selective etching stated herein is an etching treatment which selects only one of the two mutually different materials and conducts etching only to the selected material.

In one embodiment of the Present Disclosure, the spring member may be formed on the side of the sheet. According to this embodiment, the height (thickness) of the connector can be reduced.

In one embodiment of the Present Disclosure, the spring member comprises a fixating member and a movable member which extends from the fixating member towards the edge. The spring member may comprise a stand formed on the opposite side from the fixating member of the spring member with the sheet in between. According to this embodiment, when the contacting protrusion is pressed down, the entire portion of the conductive member is not undesirably lowered, and thus the deterioration of the performance of the spring can be prevented.

In one embodiment of the Present Disclosure, the spring member comprises a fixating member and a movable member which extends from the fixating member towards the edge. The fixating member may be comprised of a side fixating member which is located either on the right side or the left side of the movable member. According to this embodiment, the length of the spring member (the length of the movable member in its extended direction) is controlled, and the supporting strength which the fixating member provides for the movable member can be increased at the same time.

In one embodiment of the Present Disclosure, the protrusion may be formed from a metal plate through an etching treatment. According to this embodiment, the inconsistency in the height of the spring can be reduced, as compared to the case in which the protrusion is formed through an etching treatment from a metal layer formed through plating. If the metal layer for forming the protrusion is formed through a plating treatment, and the protrusion is formed from the resulting metal layer through an etching treatment, it requires a long time to obtain a metal layer possessing a level of thickness equivalent to the height of the protrusion. In this embodiment, the protrusion is formed from a metal plate through an etching treatment, and thus the time required to form the protrusion can be shortened.

Moreover, in one embodiment of the Present Disclosure, the spring member may possess two movable members as stated above which share an edge, and the middle member and the protrusion may be formed on the shared edge. According to this embodiment, the elasticity of the respective spring members can be increased.

Moreover, in order to solve the problem stated above, the method for manufacturing a connector possessing an insulating sheet according to the Present Disclosure comprises:

- the step of preparing a laminate possessing a first metal layer and a second metal layer;
- a step of forming a spring member on the opposite side of the first metal layer with the second metal layer in between;
- the step of forming a protrusion at a location on the edge of the spring member from the first metal layer through etching; and
- the step of forming a middle member at a location between the protrusion and the edge of the spring member from the second metal layer through etching;
- wherein the first metal layer and the second metal layer are formed with materials which are mutually different and thus enable selective etching.

According to the Present Disclosure, when the protrusion is formed from the first metal layer through the etching treatment, the spring member can be protected by the second metal layer which is not eroded by the above-stated etching treatment. Consequently, the shape of the spring member is made appropriate.

Moreover, in one embodiment of the Present Disclosure, the first metal layer may be a metal plate. According to this embodiment, the inconsistency in the height of the spring member can be reduced, as compared to the case in which the protrusion is formed through the etching treatment from the first metal layer which has been formed through plating on the second metal layer. Moreover, if the first metal layer is formed through the plating treatment, it requires a long time to achieve the thickness of the first metal layer so as to be equivalent to the height of the protrusion. In this embodiment, because the first metal layer is a metal plate, the first metal layer which is thick can be obtained without spending a long time on it.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
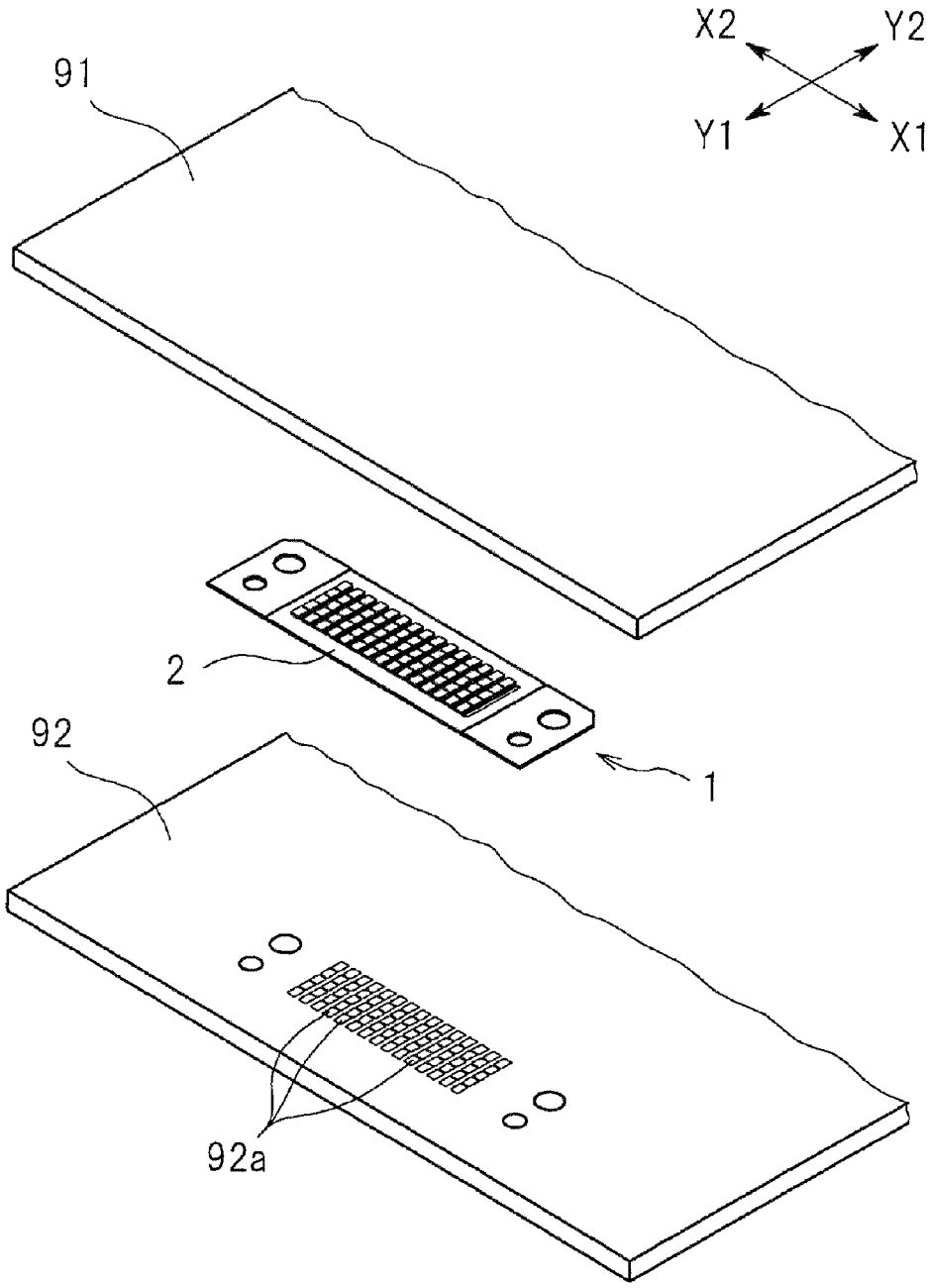
FIG. 1 is an oblique view of the sheet-like connector of one embodiment of the Present Disclosure.
Figure 2:
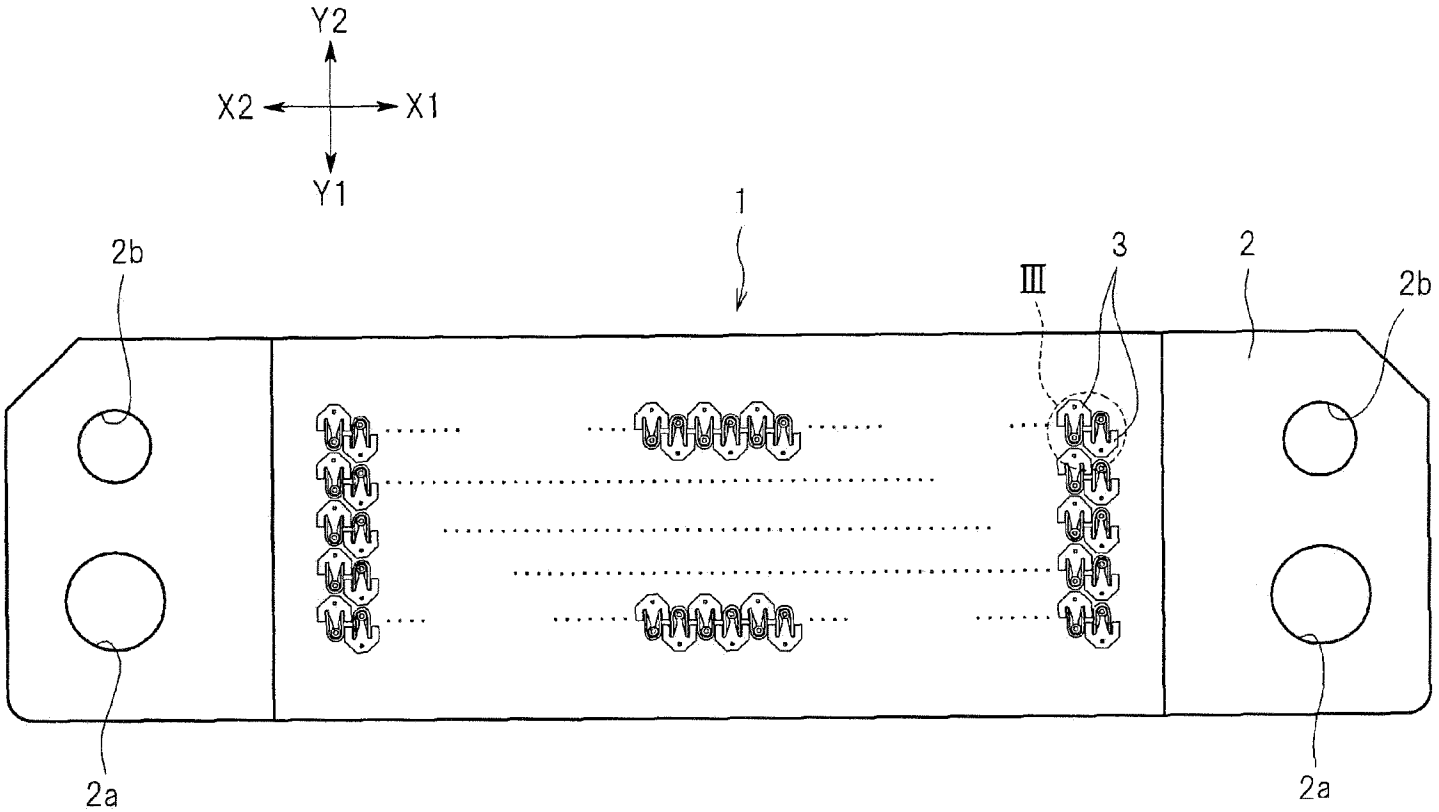
FIG. 2 is a plan view of the connector as a whole.
Figure 3:
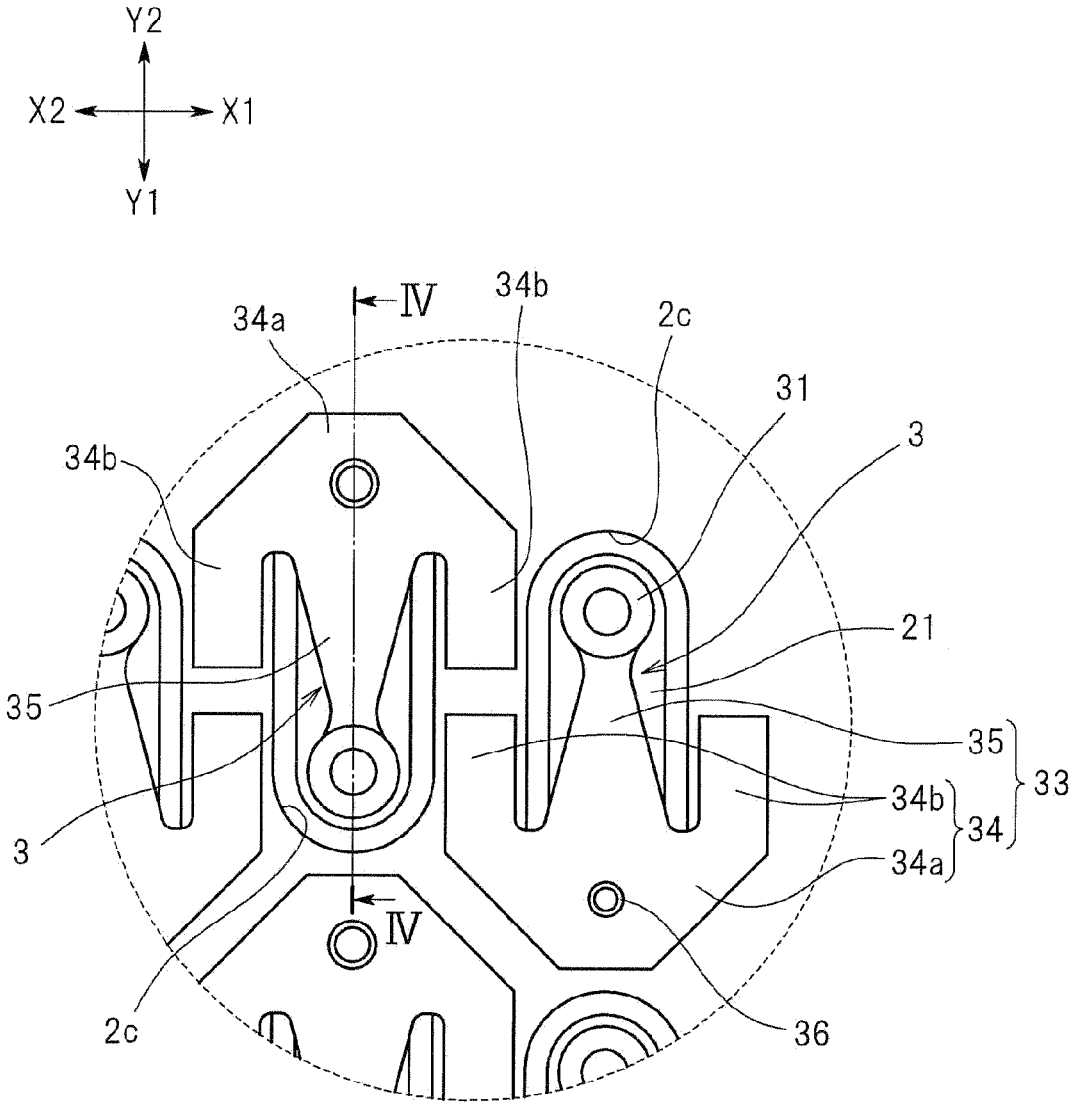
FIG. 3 is an enlarged plan view of the portion shown by dotted line III in FIG. 2.
Figure 4:
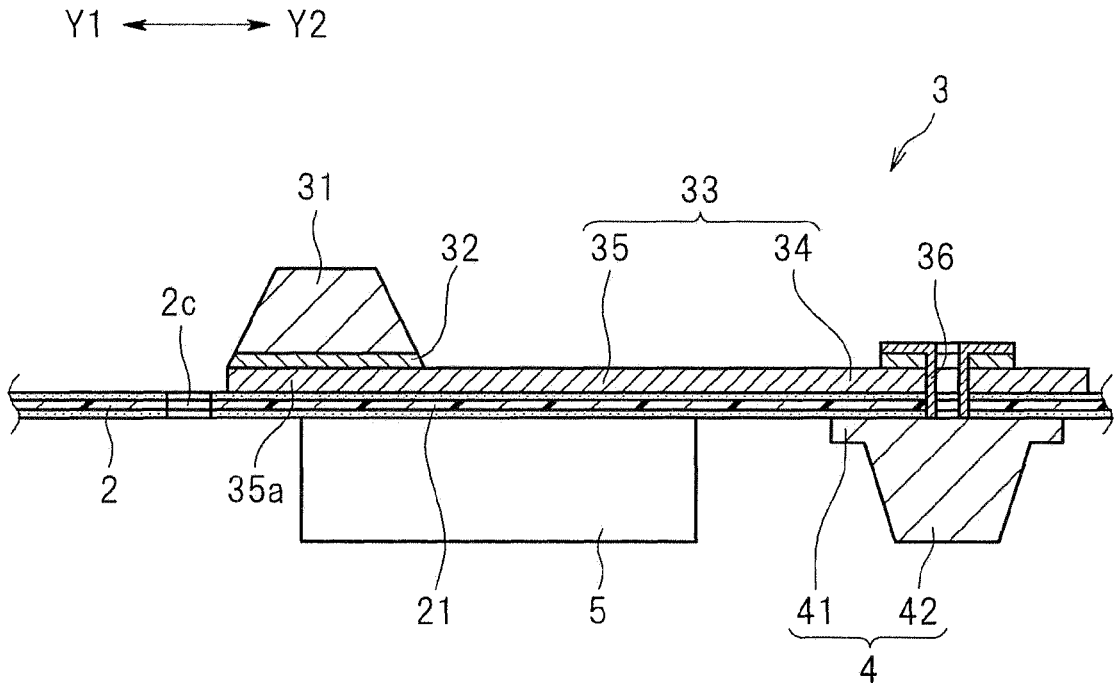
FIG. 4 is a cross-sectional view of the portion shown by Line IV-IV in FIG. 3.
Figure 5:
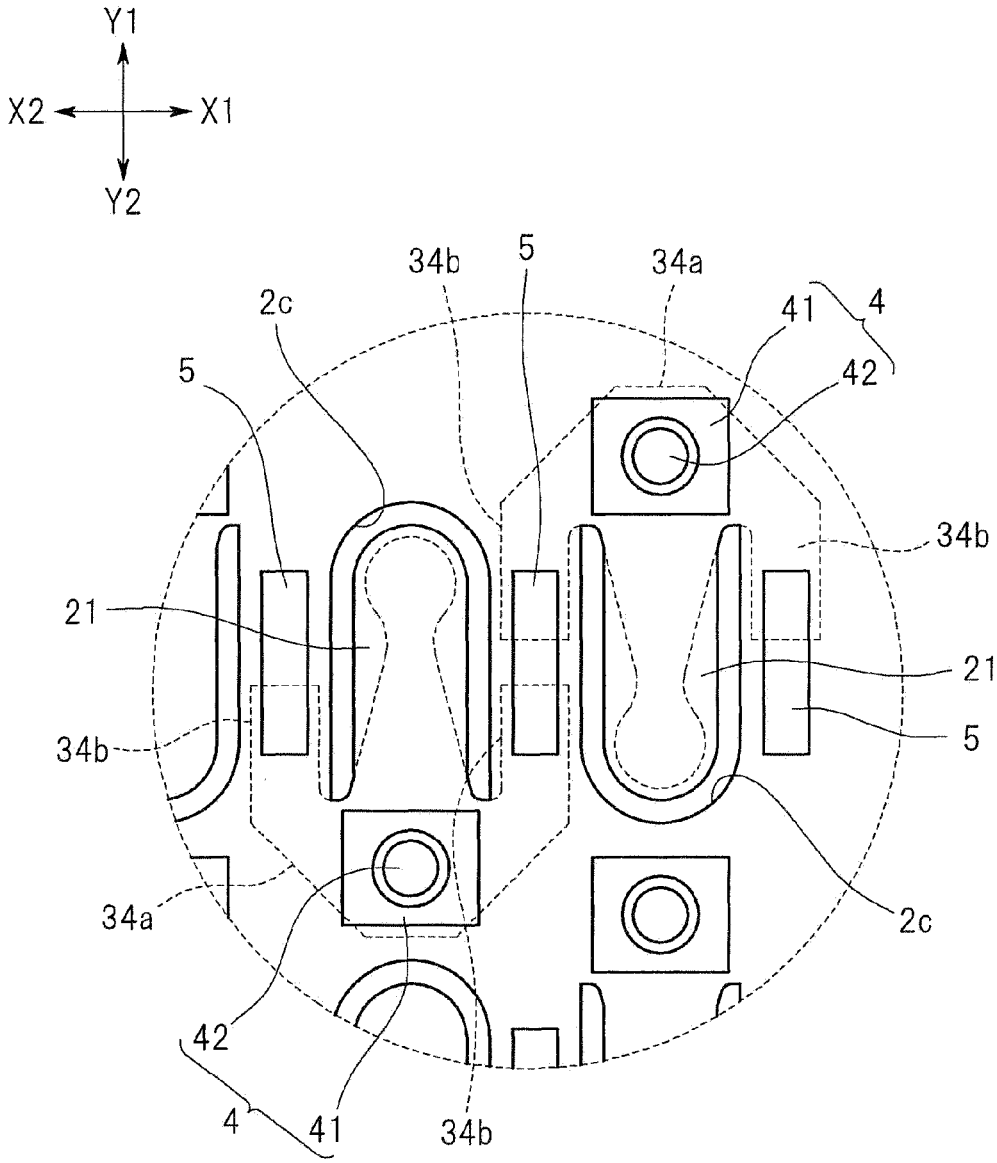
FIG. 5 is an enlarged bottom view of the connector.
Figure 6:
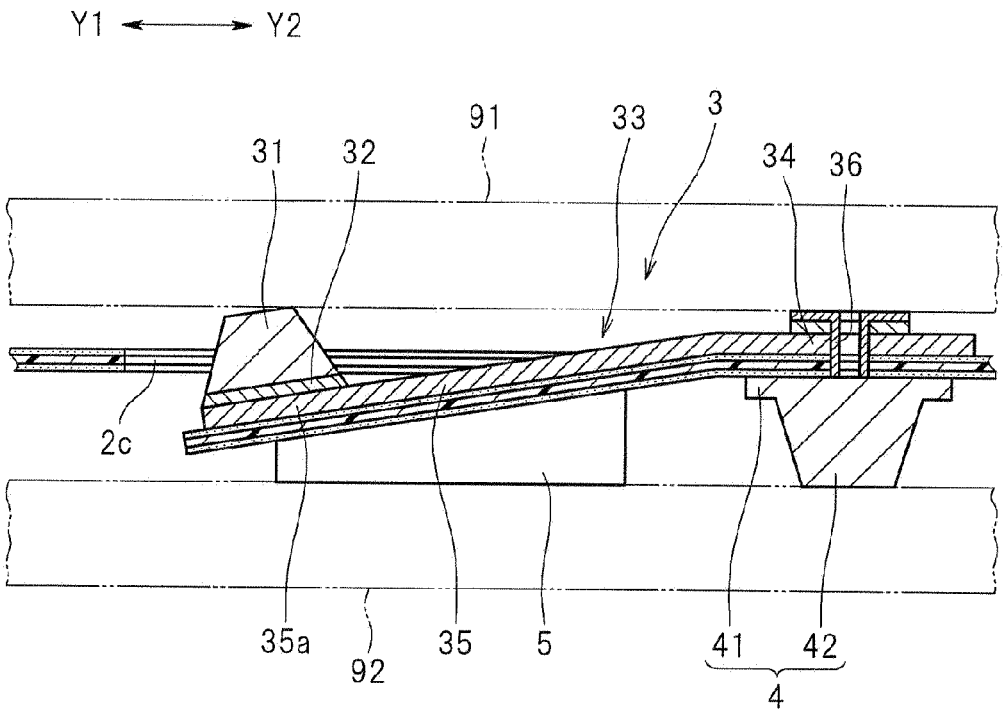
FIG. 6 is an illustration showing the connector in use; in this illustration, the connector is provided between two circuit boards.

An explanation of one embodiment of the Present Disclosure is provided below with drawings utilized as a reference. FIG. 1 is an oblique view of sheet-like connector 1 of one embodiment of the Present Disclosure, and FIG. 2 is a plan view of connector 1 as a whole. FIG. 3 is an enlarged plan view of the portion shown by dotted line III in FIG. 2. FIG. 4 is a cross-sectional view of the portion shown by dotted line IV-IV in FIG. 3. FIG. 5 is a bottom view of connector 1. FIG. 6 is an illustration showing connector 1 in use; in this illustration, the connector is provided between two circuit boards 91 and 92.

As shown in FIG. 1, connector 1 is a connector which is provided between two mutually facing circuit boards 91 and 92, and which electrically connects these circuit boards. As shown in FIGS. 2 to 4, connector 1 comprises sheet 2, first conductive member 3 which is formed on one side (in this example, on the upper side) of sheet 2, and second conductive member 4, which is formed on the other side (on the lower side) and electrically connected to first conductive member 3. First conductive member 3 and second conductive member 4 come into contact with conductive pad 92*a* (see FIG. 1), which is formed on the surface of circuit boards 91 and 92.

Sheet 2 is formed with a material possessing insulating capability and elasticity (for example, polyimide film or polyester film). Sheet 2 in this example takes a long rectangular shape which is long in the left-right direction (the direction shown by X1-X2). On sheet 2, holes 2*a* and 2*b* are formed on the left and right of a plurality of conductive members 3 and 4. Holes 2*a* and 2*b* are utilized either for fixation onto one circuit board 92, or for determining the positions.

As shown in FIG. 2, a plurality of first conductive members 3 are provided in a grid-like manner. Specifically, first conductive members 3 are aligned in the left-right direction and the front-rear direction (the direction shown by Y1-Y2). As is later explained in more detail, two first conductive members 3 which are neighboring in the left-right direction are formed in a manner such that their respective facing directions are mutually reversed.

As shown in FIG. 3 or FIG. 4, each conductive member 3 possesses spring member 33, which takes a plate spring shape and is elastically deformable in a manner so that edge 35*a* can be moved in the thickness direction. Moreover, each conductive member 3 possesses middle member 32, which is formed on edge 35*a*, and contacting protrusion 31, which is formed on middle member 32 and protrudes in the thickness direction (herein, in the upper direction) of sheet 2. When one circuit board 91 is provided on connector 1, contacting protrusion 31 is pressed down by circuit board 91 (see FIG. 6). Consequently, contacting protrusion 31 is pressed by the elastic force of spring member 33 against the conductive pad (not shown in the figure) of circuit board 91.

As shown in FIG. 3 or FIG. 4, spring member 33 possesses fixating member 34 of a plate shape and movable member 35, which extends from fixating member 34 towards edge 35*a* in a linear manner and which becomes inclined in an elastic manner when contacting protrusion 31 is pressed down. Fixating member 34 and movable member 35 are formed with one metal plate, and provided in the same plane, as stated later.

Movable member 35 is formed into a slender plate. The width of movable member 35 gradually becomes wider as it extends towards fixating member 34. When contacting protrusion 31 is pressed down, fixating member 34 of spring member 33 is caused to function as a fixated cantilever, and thus movable member 35 bends. As shown in FIG. 3, fixating member 34 possesses main plate member 34*a*, which is provided on the base side of movable member 35. The width of main plate member 34*a* is wider than the width of the base of movable member 35. Because of the above, the stability of the support provided by movable member 35 is increased. Moreover, fixating member 34 possesses side plate member 34*b* extending to the right and the left. Side plate member 34*b* extends from the right side and the left side of main plate member 34*a* in the same direction that movable member 35 extends, and is located on the right side and the left side of movable member 35. Because of the constitution stated above, when movable member 35 bends, the load applied to spring member 33 is dispersed in a wide range of fixating member 34. Consequently, the durability of spring member 33 can be improved.

Spring member 33 is formed on the surface of sheet 2. In other words, both fixating member 34 and movable member 35 are provided on sheet 2. In this example, as shown in FIG. 3 or FIG. 4, sheet 2 possesses slender movable section 21, on which movable member 35 is formed. Fixating member 34 is provided on the base side of movable section 21 on sheet 2. Moreover, as stated later, spring member 33 is adhered to sheet 2 by means of an adhesive. The outer circumference of movable section 21 is surrounded by groove 2*c*, which passes through sheet 2, and movable section 21 is connected to the remaining portion of sheet 2 via one of the ends thereof. Because of this constitution, movable section 21 can also become inclined when movable member 35 becomes inclined.

Two first conductive members 3 which are adjacent to each other in the right-left direction are facing in mutually reversed directions. Specifically, as shown in FIG. 3, movable members 35 of two adjacent first conductive members 3 respectively extend into the mutually reversed directions from fixating member 34. When contacting protrusion 31 is pressed down and movable member 35 becomes inclined, a force which tries to lift up the rear portion thereof is acted upon fixating member 34. Nonetheless, in connector 1, because the facing directions of two adjacent movable members 35 are mutually reversed, the force which tries to lift up the rear portion of fixating member 34 can be negated by a force applied to edge 35*a* of adjacent movable member 35.

Moreover, a part of two adjacent first conductive members 3 are provided so as to overlap relative to the locations in the right-left-direction. In other words, as shown in FIG. 3, side plate members 34*b* of two first conductive members 3 which are adjacent in the right-left-direction are mutually facing in the front-rear direction. Consequently, the density of providing first conductive members 3 can be enhanced.

As stated above, middle member 32 is formed on edge 35*a* of movable member 35. Middle portion 32 takes a shape which corresponds to the bottom of contacting protrusion 31. In this example, the bottom of contacting protrusion 31 takes a round shape, and middle member 32 also takes a round shape which corresponds to the size of the bottom of contacting protrusion 31.

Middle member 32 is formed with a conductive material different from the material which forms contacting protrusion 31 and spring member 33. Specifically speaking, middle member 32 and contacting protrusion 31 are formed with mutually different materials which enable selective etching. Moreover, spring member 33 is formed with a material which is different from the material forming middle member 32, and which thus enables selective etching between the material forming spring member 33 and the material forming middle member 32. For example, contacting protrusion 31 and spring member 33 are formed with copper or copper alloys (for example, copper-beryllium alloys, copper-titanium alloys, phosphor bronze, corson alloys, etc.). On the other hand, middle member 32 is formed with nickel, stainless, and the like, as examples. As stated later, in the manufacturing process of connector 1, the metal layer for forming middle member 32 functions as the layer for protecting spring member 33. Moreover, contacting protrusion 31 and spring member 33 may be formed with the same material, or with mutually different materials. For example, contacting protrusion 31 may be formed with copper, and spring member 33 may be formed with a copper alloy, the spring property of which is superior to that of copper (for example, copper-beryllium alloys and the like as stated previously).

As stated above, contacting protrusion 31 is formed on middle member 32. Contacting protrusion 31 is formed in a manner so as to protrude in the upper direction, and the height thereof is more than the thickness of middle member 32 and the thickness of spring member 33. As stated later, contacting protrusion 31 is formed with a metal plate which is formed by means of rolling and which possesses a level of thickness equivalent to the height of contacting protrusion 31. This prevents the height of contacting protrusion 31 from becoming inconsistent between a plurality of conductive members 3.

As shown in FIG. 4, contacting protrusion 31 is formed in a manner so that the upper portion thereof (the portion more distant from edge 35*a*) is thicker than the lower portion thereof (the portion more proximal to edge 35*a*). Because of this design, even when contacting protrusion 31 is formed to be high, contacting protrusion 31 is less likely to be damaged when it is pressed down by circuit board 92. In this example, contacting protrusion 31 takes a round shape as its cross-sectional view to match the shape of edge 35*a* of movable member 35. Specifically, contacting protrusion 31 is formed into a shape of an approximate circular truncated cone. Due to this shape, the cross-sectional surface of contacting protrusion 31 becomes gradually larger towards edge 35*a*. Moreover, contacting protrusion 31 may be formed into a pillar-like shape with a consistent thickness.

As shown in FIG. 6, when contacting protrusion 31 is pressed down, movable member 35 becomes inclined, mostly centered around its base. Due to the above, the location of contacting protrusion 31 is slightly shifted in the front-rear direction relative to the conductive pad on circuit board 91. As a result of the above, an oxide film which has been formed on the surface of the conductive pad on circuit board 91 is removed by contacting protrusion 31, and thus a favorable electrical connection can be obtained.

Second conductive member 4 is formed on the opposite side of first conductive member 3, with sheet 2 in between. As shown in FIG. 4 and FIG. 5, second conductive member 4 in this example is provided on the opposite side of main plate member 34*a*, with sheet 2 in between. Second conductive member 4 possesses base 41, which is provided on the rear side of sheet 2, and mounting projection 42, which projects from base 41 in the opposite direction of contacting protrusion 31 (in this example, in the lower direction). When connector 1 is provided on circuit board 91, mounting projection 42 is fixated onto the conductive pad formed on circuit board 91 by means of welding or other means.

Mounting projection 42 is formed in a manner so that the upper portion thereof (the portion more proximal to base 41) is thicker than its lower portion (the portion more distant from base 41). Because of this design, mounting projection 42 is less likely to be damaged. In this example, mounting projection 42 is formed into an approximate circular truncated cone, similar to contacting protrusion 31, and thus the thickness (on the cross-sectional surface) thereof becomes gradually larger towards base 41. Moreover, mounting projection 42 may be formed into a pillar-like shape with a consistent thickness.

As shown in FIG. 4 and FIG. 5, base 41 is formed in a manner so as to be larger than the base of mounting projection 42, as the bottom view of connector 1. In this example, base 41 is formed into a shape of a rectangular plate, and mounting projection 42 possesses a round shape in its cross-sectional view, which is smaller than that of base 41.

As shown in FIG. 4, connector 1 also comprises conductive path 36, which electrically connects second conductive member 4 and first conductive member 3. Conductive path 36 passes through sheet 2, and connects main plate member 34*a* and base 41 of second conductive member 4. In this example, a blind via is formed as conductive path 36 on main plate member 34*a*. In other words, the hole which passes through both main plate member 34*a* and sheet 2 and which reaches base 41 of second conductive member 4, as well as the metal which is formed on the inner side and on the edge of the hole function as conductive path.

As shown in FIG. 4 and FIG. 5, stand 5 is formed on the opposite side of fixating member 34 of spring member 33, with sheet 2 in between. In this example, stand 5 is formed on the opposite side of side plate member 34*a*. Stand 5 is fixated onto the rear surface of sheet 2, and possesses a height equivalent to the height of second conductive member 4. Due to the above, when connector 1 is provided on circuit board 91, stand 5 is located on circuit board 91 to support side plate member 34*b*. In other words, stand 5 prevents side plate member 34*b* from becoming inclined together with movable member 35. Second conductive member 4 and stand 5 support the entire portion of fixating member 34 of first conductive member 3.

Stand 5 is formed into an approximate rectangular parallelepiped which is long in the rolling direction of side plate member 34*b*. In this example, respective stands 5 support respective side plate members 34*b* of two adjacent first conductive members 3. In other words, respective side plate members 34*b* of two adjacent first conductive members 3, which are adjacent in the right-left-direction, are arranged in the front-rear-direction, as stated above (see FIG. 3). Respective stands 5 support both of side plate members 34*b* arranged in the front-rear-direction.

Stand 5 is formed with a metal, and secures the support provided for first conductive member 3. In this example, stand 5 is formed with the same material with which second conductive member 4 is formed (for example, copper). Because of the above, stand 5 can be formed through the same etching process with which second conductive member 4 is formed. Moreover, stand 5 is not electrically connected to side plate member 34*b*.

Figure 7:
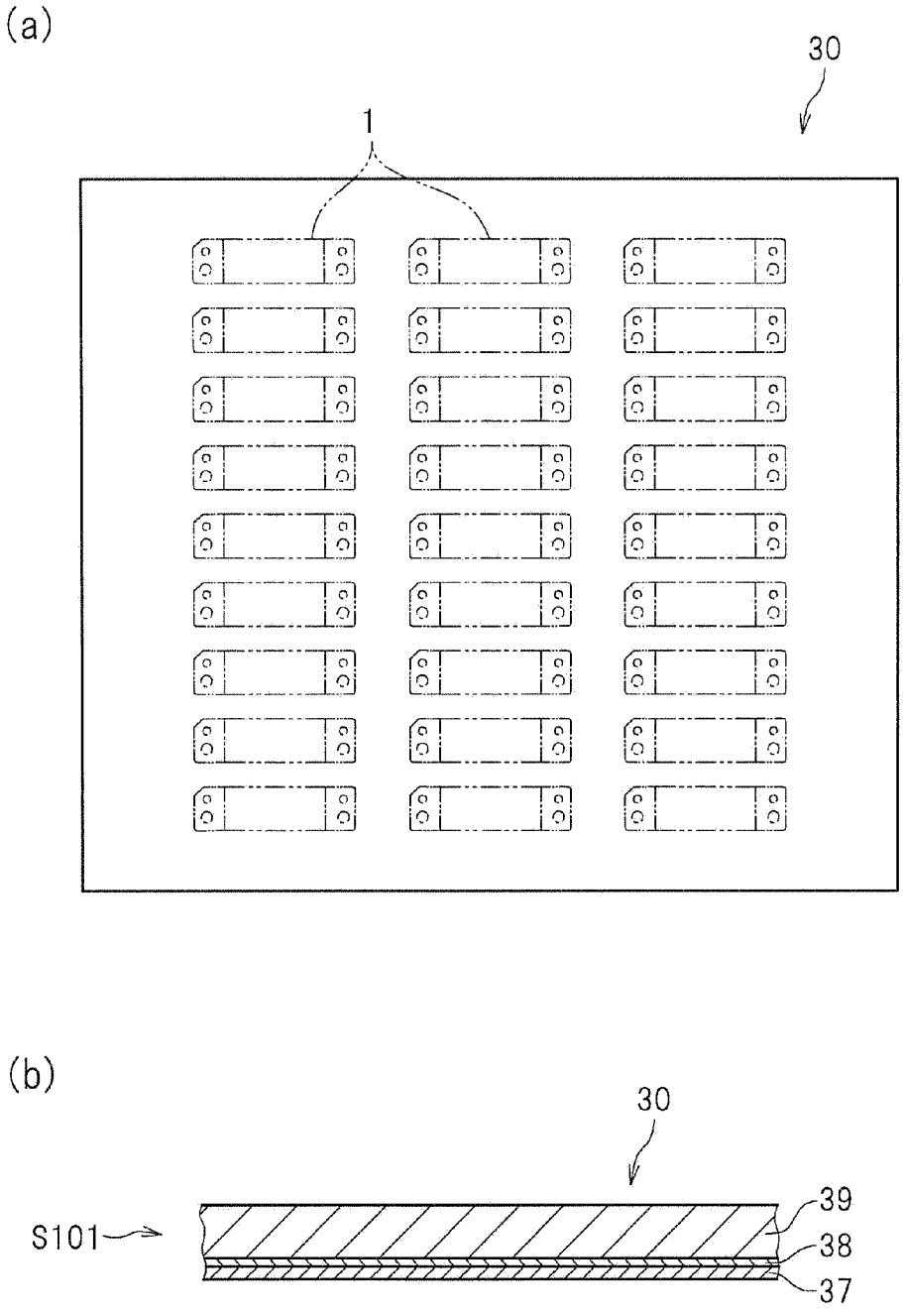
FIG. 7 is an illustration showing the manufacturing processes of the connector.
Figure 8:
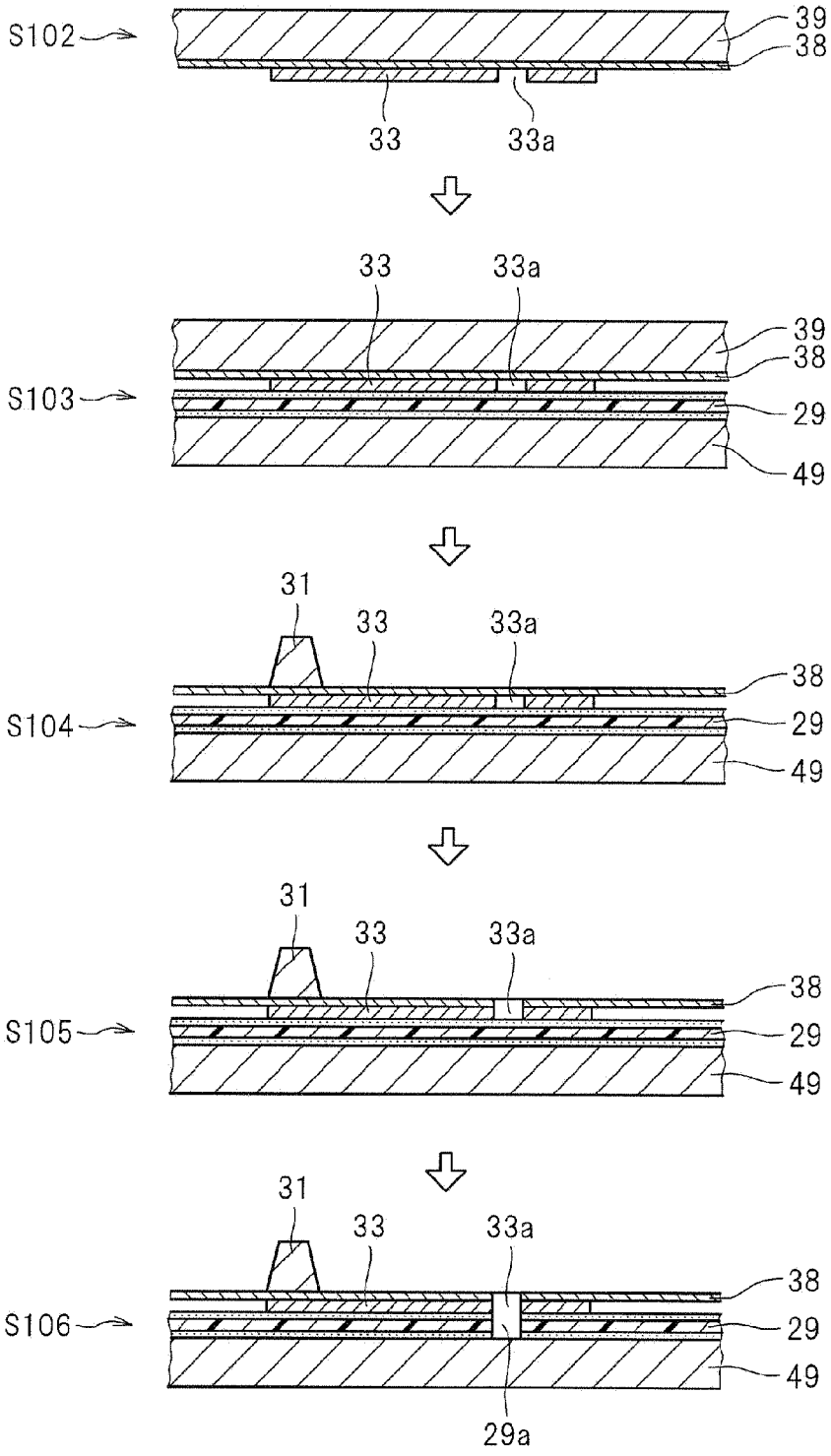
FIG. 8 is an illustration showing the manufacturing processes of the connector.
Figure 9:
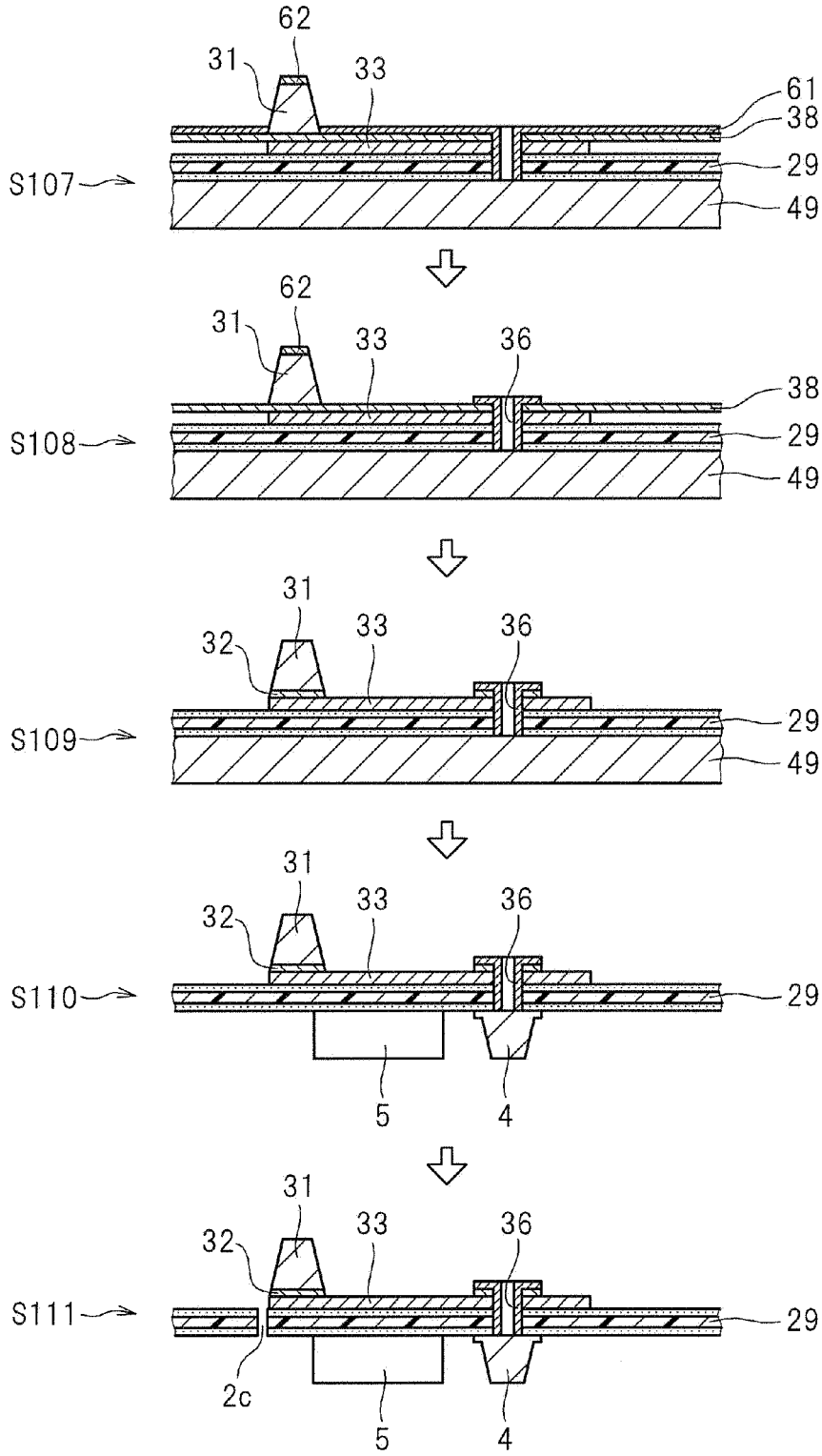
FIG. 9 is an illustration showing the manufacturing processes of the connector.

An explanation of the manufacturing method for connector 1 is provided below. FIG. 7 to FIG. 9 constitute figures showing the manufacturing method for connector 1.

As shown in FIG. 7(*b*), first of all, laminate 30 which possesses three metal layers is prepared (S101). Laminate 30 possesses first metal layer 39 possessing a level of thickness equivalent to the height of contacting protrusion 31, and second metal layer 38 possessing a level of thickness equivalent to the thickness of middle member 32. Laminate 30 also possesses third metal layer 37, which is formed on the opposite side of metal layer 39 with metal layer 38 in between. Third metal layer 37 possesses a level of thickness equivalent to the thickness of spring member 33. In the processes which are described later, middle member 32 is formed from second metal layer 38, and contacting protrusion 31 is formed from first metal layer 39. Moreover, spring member 33 is formed from third metal layer 37.

Herein, second metal layer 38 and first metal layer 39 are formed with mutually different materials enabling the selective etching. Moreover, third metal layer 37 is formed with a material different from the material forming second metal layer 38, which enables the selective etching between third metal layer 37 and second metal layer 38. For example, the material forming first metal layer 39 is a copper as an example; and the material forming third metal layer 37 is a material which is superior to the material forming first metal layer 39 in terms of the spring property, exemplified as copper alloys such as copper-beryllium alloys, copper-titanium alloys, phosphor bronze, corson alloys, and the like as stated above. On the other hand, the material forming second metal layer 38 is nickel or stainless, for example, as stated above.

Laminate 30 is a clad plate which is formed through rolling. For example, laminate 30 possesses three metal plates which have been formed through rolling as first metal layer 39, second metal layer 38, and third metal layer 37 and which are joined together to form laminate 30. Joining of these three metal plates is also conducted through rolling, for example. Moreover, second metal layer 38 does not have to be a metal plate. In other words, second metal layer 38 may be formed through a plating treatment, either on the surface of the metal plate for forming first metal layer 39, or on the surface the metal plate for forming third metal layer 37. Subsequently, the metal plate for forming first metal layer 39 and the metal plate for forming third metal layer 37 may be joined together with second metal layer 38 in between. By forming first metal layer 39 from the metal plates which have been formed through rolling, the thickness of first metal layer 39 can be made consistent on all of the spots on the resulting layer. Moreover, by utilizing the metal plates to form first metal layer 39 for forming contacting protrusion 31, the height of contacting protrusion 31 can be more easily increased, as compared to the case in which contacting protrusion 31 is formed through a plating treatment.

Moreover, in order to form a plurality of connectors 1 from one laminate 30, laminate 30 possesses a size corresponding to the plurality of connectors 1, as shown in FIG. 7(*a*).

Subsequently, as shown in FIG. 8, spring member 33 is formed in the opposite side from first metal layer 39 of second metal layer 38 (S102). In this example, spring member 33 is formed from third metal layer 37 through an etching treatment. In other words, a resist pattern is formed on third metal layer 37, and third metal layer 37 is partially removed by following along the resist pattern to form spring member 33. In this treatment, selective etching is conducted by utilizing an etching solution which removes only third metal layer 37 out of third metal layer 37 and second metal layer 38. Moreover, first metal layer 39 is protected by second metal layer 38 from the etching solution. Moreover, in this process, hole 33*a* is also formed on spring member 33 at a location corresponding to the location of conductive path 36.

Subsequently, metal layer 49 (hereafter, referred to as the opposite metal layer), which possesses a level of thickness equivalent to the height of second conductive member 4 and stand 5; and sheet 29, which serves to form insulating sheet 2, are prepared. Opposite metal layer 49 is a metal layer for forming second conductive member 4 and stand 5. Subsequently, as shown in S103 in FIG. 8, laminate 30 is attached to one side of sheet 29 with an adhesive in a manner so that spring member 33 is sandwiched between laminate 30 and sheet 29. Moreover, opposite metal layer 49 is attached to the other side of sheet 29 with the adhesive. To form opposite metal layer 49, a metal plate which has been formed through rolling (for example, a copper plate) may be utilized. Moreover, sheet 29 and opposite metal layer 49 respectively possess a size corresponding to the plurality of connectors 1.

Subsequently, contacting protrusion 31 is formed from first metal layer 39 through an etching treatment (S104). In other words, a resist pattern is formed on first metal layer 39, and third metal layer 37 is partially removed by following along the resist pattern to form spring member 33. At this time, the etching solution utilized is an etching solution which removes only the material for first metal layer 39 from among the materials for second metal layer 38 and first metal layer 39. In this process, spring member 33 is protected by second metal layer 38 from the etching solution, and thus the shape of spring member 33 is appropriately maintained.

Moreover, in this example, contacting protrusion 31 is formed in a manner so that its lower portion is fatter than its upper portion. Because of this design, contacting protrusion 31 is formed through a plurality of etching treatments. In other words, contacting protrusion 31 is formed by repeating the formation of the resist pattern and the subsequent partial removal of first metal layer 39 by means of the etching solution.

Subsequently, a perforating hole is formed on second metal layer 38 at a location corresponding to hole 33*a* (S105). For example, a resist pattern is formed on second metal layer 38, and the perforating hole is formed through an etching treatment. At this time, the etching solution utilized is an etching solution which removes only the material for second metal layer 38 from among the materials for second metal layer 38 and first metal layer 39. Subsequently, perforating hole 29*a* is formed in sheet 29 (S106). The location of perforating hole 29*a* also corresponds to the location of hole 33*a*. Perforating hole 29*a* is formed by means of laser treatment or mechanical treatment, for example.

Subsequently, as shown in S107 in FIG. 9, a metal is caused to be deposited on the surface of second metal layer 38 as well as on the inner surfaces of perforating hole 29*a* and hole 33*a* to form conductive layer 61. Conductive layer 61 is formed, for example, with the same material (for example, copper) as the material forming first metal layer 39. Moreover, prior to the plating treatment for forming conductive layer 61, a resist film is formed on the upper surface of contacting protrusion 31 so that the deposition of conductive layer 61 on contacting protrusion 31 is prevented. Subsequently, the resist film is removed. Moreover, instead of forming such resist film as stated above on contacting protrusion 31, conductive layer 61 is may be formed on contacting protrusion 31 through a plating treatment. By doing so, the height of contacting protrusion 31 can be increased.

Subsequently, the portion of conductive layer 61 excluding conductive path 36 is removed through the etching treatment to form conductive path 36 (S108). Specifically, a resist pattern is formed not only in conductive layer 61 but also on contacting protrusion 31, and conductive layer 61 is removed following along the pattern. At this time, spring member 33 is protected by second metal layer 38 from the etching solution. Moreover, in this example, as shown in S107 in FIG. 9, prior to the etching treatment for forming conductive path 36 from conductive layer 61, protecting layer 62 made out of the same metal material used for second metal layer 38 (for example, nickel) is formed through a plating treatment on the upper surface of contacting protrusion 31. By doing so, in the process of etching conductive layer 61, contacting protrusion 31 is protected by protecting layer 62.

Subsequently, second metal layer 38 is removed through the etching treatment (S109). By doing so, middle member 32, which is to be provided between edge 35*a* of spring member 33 and contacting protrusion 31, is formed. Moreover, the etching treatment in S109 also removes protecting layer 62.

Subsequently, a resist pattern, which corresponds to the location of second conductive member 4 and the location of stand 5, is formed on opposite metal layer 49; then opposite metal layer 49 is partially removed through the etching treatment, and thus second conductive member 4 and stand 5 are formed (S110). Moreover, in this example, the height of mounting projection 42 which second conductive member 4 possesses is relatively high, and second conductive member 4 possesses a base with which the cross-sectional surface is larger than mounting projection 42. Due to the above, in the process of forming these members, multiple rounds of etching treatments are conducted. In other words, second conductive member 4 and stand 5 are formed by repeating the formation of the resist pattern and the subsequent partial removal of opposite metal layer 49 by means of the etching solution.

Subsequently, groove 2*c*, which surrounds movable member 35, is formed on sheet 29, and movable section 21 is formed (S111). Groove 2*c* is formed, for example, by means of laser treatment. Subsequently, both sides of sheet 29 are treated with plating (for example, with nickel plating or gold plating, etc.) to prevent the corrosion, and then sheet 29 is cut into each sheet 2. Connector 1 is formed by the above.

As has been explained above, connector 1 comprises insulating sheet 2 and a plurality of first conductive members 3 which are formed on one side of sheet 2. Each first conductive member 3 comprises spring member 33, which is designed to be elastically deformable 32 so that edge 35*a* can be moved into the thickness direction sheet 2; middle member 32, which is formed on edge 35*a* of spring member 33; and contacting protrusion 31, which is formed on middle member 32 and which protrudes into the thickness direction of sheet 2. Moreover, middle member 32 and contacting protrusion 31 are formed with mutually different materials which enable the selective etching. According to such connector 1 as stated above, when forming contacting protrusion 31 from a metal layer through the etching treatment, spring member 33 or the metal layer for forming spring member 33 can be protected by the metal layer for forming middle member 32. Consequently, the shape of spring member 33 can be appropriately made.

Moreover, the Present Disclosure is not limited to connector 1 which has been explained as the above, and it may be varied in many different ways.

For example, in the explanation provided above, spring member 33 is formed into a plate spring form, and possesses one movable member (specifically, movable member 35). However, spring member 33 may possess a plurality of movable members which share one edge. Additionally, contacting protrusion 31 may be formed in the edge.

Figure 10:
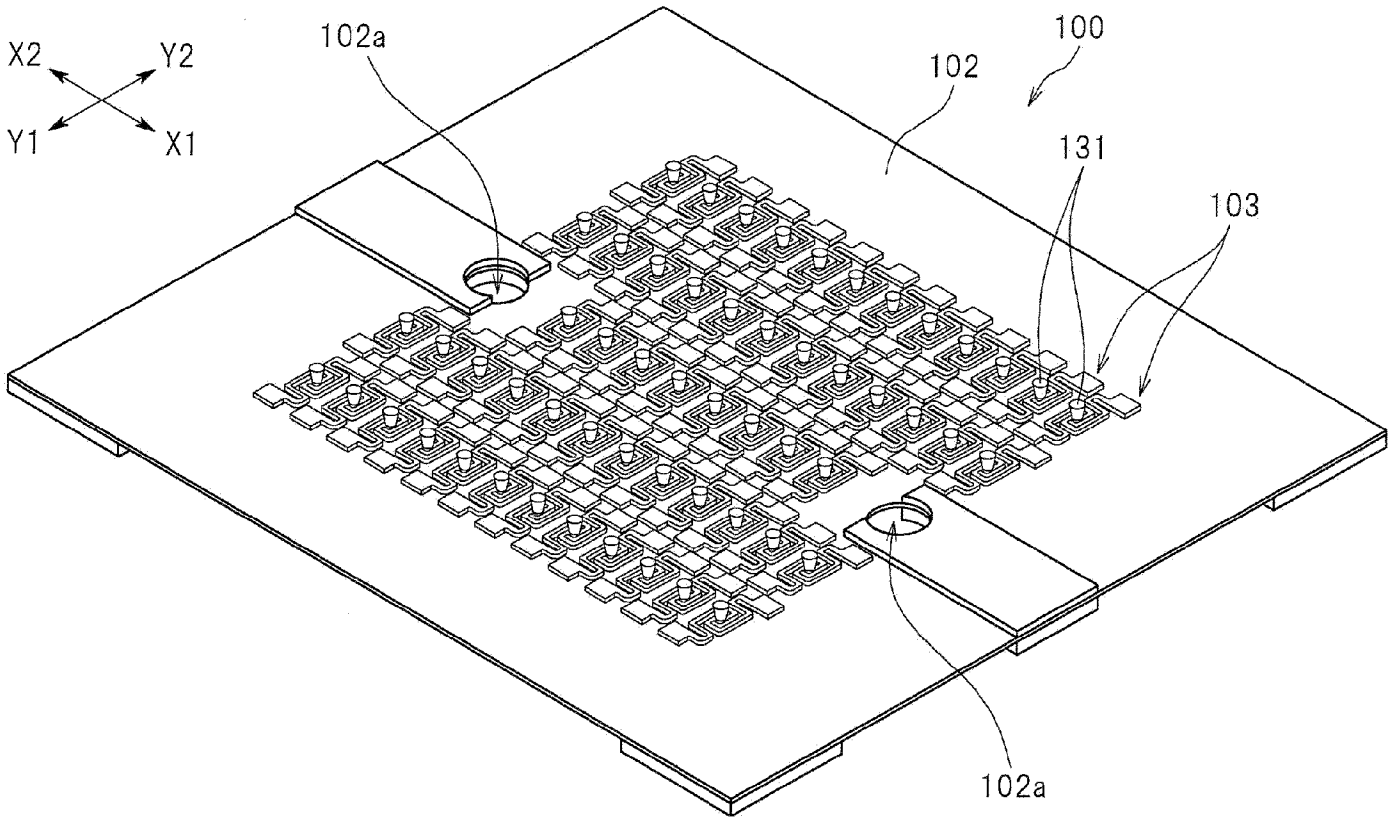
FIG. 10 is an oblique view of the sheet-like connector of another embodiment of the Present Disclosure.
Figure 11:
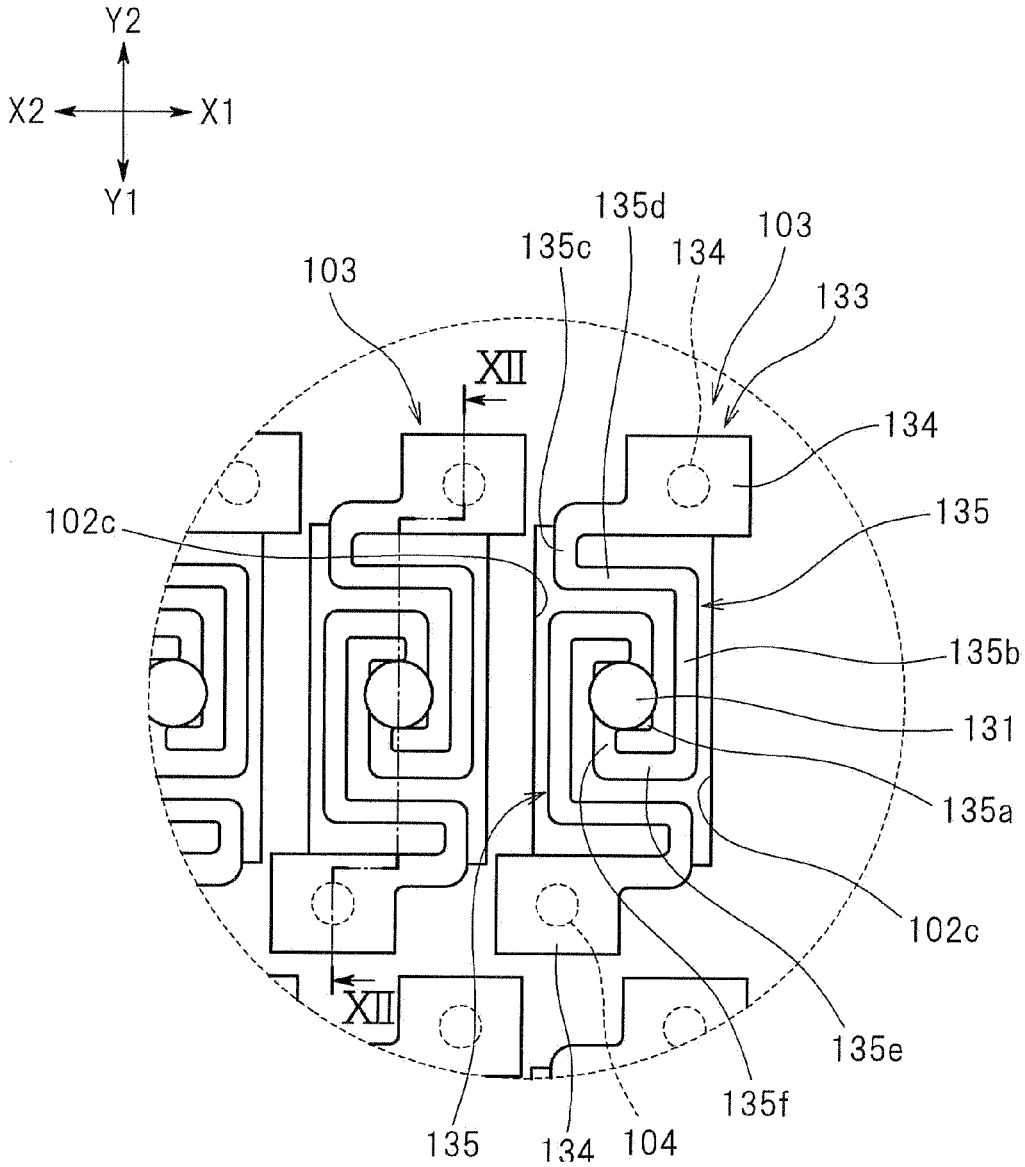
FIG. 11 is an enlarged plan view of the connector shown in FIG. 10.
Figure 12:
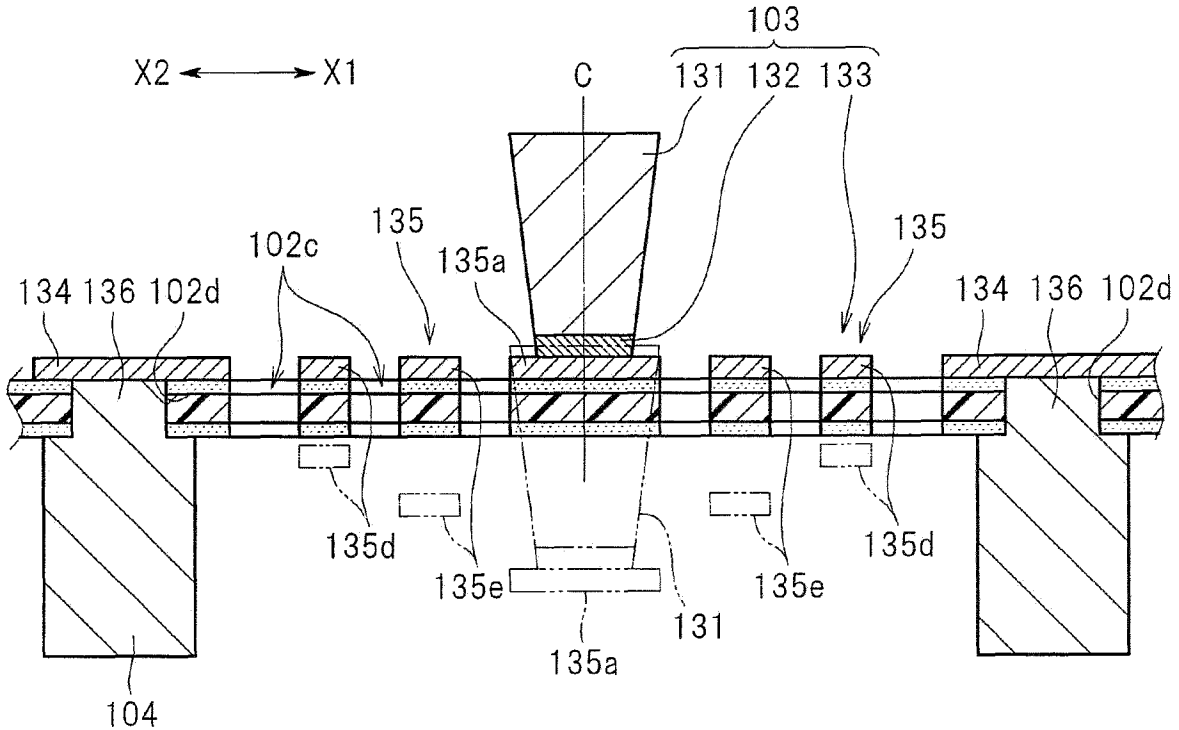
FIG. 12 is a cross-sectional view of the portion shown by Line XII-XII in FIG. 11.

FIG. 10 to FIG. 12 show connector 100 of this embodiment. FIG. 10 is an oblique view of connector 100 seen from the upper diagonal direction. FIG. 11 is an enlarged plan view of connector 100. FIG. 12 is a cross-sectional view of connector 100 shown by dotted line XII-XII in FIG. 11. Moreover, in FIG. 12, first conductive member 103, which is pressed down by the circuit board, is shown by the two-dot chain line.

As shown in FIG. 10 to FIG. 12, connector 100 comprises sheet 102, a plurality of first conductive members 103, which are formed on one side (in this example, on the upper side) of sheet 102, and a plurality of second conductive members 104, which are formed on the other side (on the lower side) and which are electrically connected to first conductive members 103. In connector 100 as well, first conductive members 103 are arranged in the right-left-direction and in the front-rear-direction.

Similarly to sheet 2 previously stated, sheet 102 is formed with a material possessing insulating capability and elasticity. As shown in FIG. 10, on sheet 102, holes 102*a* are formed. Holes 2*a* are either utilized for fixation onto one circuit board 9, or to determine the positions.

As shown in FIG. 11, each conductive member 103 possesses spring member 133. Spring member 133 possesses two fixating members 134 of a rectangular shape, which are formed on sheet 2. In this example, two fixating members 134 are provided in the front-rear-direction with a distance between them. Moreover, spring member 133 possesses two slender movable members 135 which share one edge 135*a*. Two movable members 135 extend respectively from two fixating members 134, and are joined together at edge 135*a*. Two fixating members 134 are provided on the mutually opposite sides with edge 135*a* between.

As shown in FIG. 11, grooves 102*c*, which surround two movable members 135 and which pass through sheet 102, are formed on sheet 102. Due to the above, in movable members 135, similarly to movable member 35 stated above, edge 135*a* thereof is designed so as to be elastically deformable in the thickness direction of sheet 102 (see FIG. 12).

Contacting protrusion 131 of an approximate cylinder shape (to be stated later) is formed on edge 135*a*. When connector 1 is provided between two circuit boards, and contacting protrusion 131 is pressed down, contacting protrusion 131 is pressed by the elastic force from spring member 133 against the conductive pad which has been formed on one circuit board. Moreover, movable members 135 and fixating members 134 are formed respectively with one metal plate, similar to movable member 35 and fixating member 34 of spring member 33, and are located on the same plane.

Movable members 135, as shown in FIG. 11, bend at a plurality of locations between fixating members 134 and edge 135*a*. Because of the above, when edge 135*a* becomes shifted in the thickness direction of sheet 102, edge 135*a* and contacting protrusion 131 are slightly rotated around center line C of these members (see FIG. 12). As a result of the above, oxide film which has been formed on the surface of the conductive pad of one circuit board is removed by contacting protrusion 131.

In this example, each movable member 135 possesses two slender vertically-extended members 135*b* and 135*c* in the front-rear-direction, as well as two slender horizontally-extended members 135*d* and 135*e* in the right-left-direction. These 135*b*, 135*c*, 135*d*, and 135*e* are alternately linked, and movable member 135 bends at these linking locations. Moreover, vertically-extended member 135*b* extends beyond edge 135*a* towards fixating member 134 provided on the opposite side to be linked to horizontally-extended member 135*e*. Due to the above, movable member 135 further extends extended member 135*f*, which extends from the other edge of horizontally-extended member 135*e* towards shared edge 135*a* in the opposite direction from vertically-extended member 135*a*. Two movable members 135, which respectively possess these extended members 135*b*, 135*c*, 135*d*, 135*e*, and 135*f*, are formed in a manner so as to be symmetrical to edge 135*a*. In this example, two movable members 135 are formed so as to be point-symmetrical to the center of edge 135*a*. Moreover, the shape of movable members 135 is not limited to the above, and two movable members 135 may be formed so as to be line-symmetrical to the linear line of the right-and-left-direction which passes through the center of edge 135*a*.

As shown in FIG. 12, similarly to first conductive member 3, in first conductive member 103 as well, middle member 132 is formed on edge 135*a*. Moreover, contacting protrusion 131 protruding in the thickness direction of sheet 102 (in the upper direction) is formed on middle member 132. In this example, contacting protrusion 131 is formed into an approximate cylindrical shape so that its cross-sectional surface size becomes gradually larger towards the upper direction.

Similarly to middle member 32 stated above, middle member 132 and contacting protrusion 131 are formed with materials which are mutually different and which thus enable selective etching. Moreover, spring member 133 is formed with a material which is different from the material forming middle member 132 so that the selective etching is enabled between and the same and the material of middle member 132. For example, contacting protrusion 131 is formed with copper, and spring member 133 is formed with copper alloys, the spring property of which is superior to that of copper (for example, copper-beryllium alloys, copper-titanium alloys, phosphor bronze, corson alloys, etc.). On the other hand, middle member 132 is formed with nickel, stainless, and the like, as examples. Due to the above, when contacting protrusion 131 is formed through the etching treatment, spring member 133 or the metal layer for forming spring member 133 can be protected by the metal layer for forming middle member 132 from the etching solution.

As stated above, connector 1 possesses a plurality of second conductive members 104. In connector 1, two second conductive members 104 are provided per one first conductive member 103. Respective second conductive members 104 are provided on the opposite side of fixating members 134 with sheet 102 in between. Similarly to second conductive member 4 stated above, each second conductive member 104 is formed so as to protrude in the lower direction. In this example, each second conductive member 104 is formed into an approximate cylindrical shape. When connector 100 is provided on a circuit board, two second conductive members 104 are connected to one conductive pad which has been formed on the circuit board.

As shown in FIG. 12, perforating holes 102*d* are respectively formed on sheet 102 at locations below fixating members 134. Perforating holes 102*d* are filled with a metal, and thus fixating members 134 and second conductive members 104 are electrically connected via this metal (hereafter, referred to as the conductive path) 136.

Such connector 100 as stated above is formed, for example, in the following manner. First of all, similarly to connector 1, a laminate which possesses a first metal layer possessing a level of thickness equivalent to the height of contacting protrusion 131, a second metal layer possessing a level of thickness equivalent to the thickness of middle member 132, and a third metal layer possessing a level of thickness equivalent to the thickness of spring member 133, is prepared. Herein, the second metal layer and the first metal layer are formed with mutually different materials which enable the selective etching. Moreover, the material of the third metal layer is different from the material forming the second metal layer so that the selective etching is enabled between the first metal layer and the first metal layer. Similarly to laminate 30, the laminate utilized herein is a clad plate which has been formed through rolling, for example.

Subsequently, similarly to S102 process stated previously, spring member 133 is formed from the third metal layer through the etching treatment. Moreover, the laminate is attached to insulating sheet 102 with an adhesive so that spring member 133 is sandwiched between the second metal layer and spring member 133. Moreover, similarly to the S104 process stated above, the contacting protrusion is formed from the first metal layer through the etching treatment. Subsequently, grooves 102*c* and holes 102*d* are formed on sheet 102. Subsequently, conductive path 136 is formed, and second conductive members 104 are formed on the opposite side from the laminate with sheet 102 in between. For example, by plating the opposite side from the laminate with sheet 102 in between, second conductive members 104 and conductive path 136 are formed.

While a preferred embodiment of the Present Disclosure is shown and described, it is envisioned that those skilled in the art may devise various modifications without departing from the spirit and scope of the foregoing Description and the appended Claims.

What is claimed is:

1. A sheet-like connector, the connector comprising:
an insulating sheet, the sheet including a moveable section;
a plurality of conductive members formed on one side of the sheet, each conductive member comprising an elastically deformable spring member wherein the edge thereof moves in the thickness direction of the sheet, the spring member being formed on the moveable section;
a middle member formed on the edge of the spring member; and
a contacting protrusion formed on the middle member, the protrusion protruding in the thickness direction of the sheet;
wherein the middle member, the spring member and the protrusion are formed with materials which are mutually different and thus enable selective etching.

2. The sheet-like connector of claim 1, wherein the spring member is formed on one side of the sheet.

3. The sheet-like connector of claim 1, wherein the spring member comprises a fixating member.

4. The sheet-like connector of claim 3, wherein the spring member further comprises a movable member which extends from the fixating member towards the edge.

5. The sheet-like connector of claim 4, wherein a stand is formed on a side opposite from the fixating member with the sheet in between.

6. The sheet-like connector of claim 4, wherein the fixating member comprises a side fixating member located either on the right side or the left side of the movable member.

7. The sheet-like connector of claim 1, wherein the protrusion is formed from a metal plate through an etching treatment.

8. The sheet-like connector of claim 1, wherein the spring member comprises two movable members having a common edge.

9. The sheet-like connector of claim 8, wherein the middle member and the protrusion are formed on the common edge.

* * * * *